US007495645B2

(12) United States Patent
Jang

(10) Patent No.: US 7,495,645 B2
(45) Date of Patent: Feb. 24, 2009

(54) LIQUID CRYSTAL DISPLAY DEVICE CAPABLE OF PREVENTING FLICKER AND METHOD FOR DRIVING

(75) Inventor: Yong Ho Jang, Gwacheon-si (KR)

(73) Assignee: LG Display Co., Ltd., Seoul (KR)

( * ) Notice: Subject to any disclaimer, the term of this patent is extended or adjusted under 35 U.S.C. 154(b) by 555 days.

(21) Appl. No.: 11/012,121

(22) Filed: Dec. 16, 2004

(65) Prior Publication Data

US 2005/0134539 A1 Jun. 23, 2005

(30) Foreign Application Priority Data

Dec. 22, 2003 (KR) ..... 10-2003-94972

(51) Int. Cl.
*G09G 3/36* (2006.01)

(52) U.S. Cl. ..... 345/92

(58) Field of Classification Search ..... 345/87–104, 345/204

See application file for complete search history.

(56) References Cited

U.S. PATENT DOCUMENTS 5,648,793 A * 7/1997 Chen ..... 345/96
5,691,740 A * 11/1997 Onitsuka et al. ..... 345/96
6,310,594 B1 * 10/2001 Libsch et al. ..... 345/90
6,476,787 B1 * 11/2002 Libsch et al. ..... 345/92
2003/0169223 A1 9/2003 Lee et al.

FOREIGN PATENT DOCUMENTS

GB WO2004/0113836 A1 * 2/2004

* cited by examiner

*Primary Examiner*—Sumati Lefkowitz
*Assistant Examiner*—Robert E Carter III
(74) *Attorney, Agent, or Firm*—McKenna Long & Aldridge LLP

(57) ABSTRACT

A liquid crystal display device and a driving method thereof for improving a picture quality are disclosed. In the liquid crystal display device, a plurality of liquid crystal cells is provided at crossings of a plurality of data lines and a plurality of gate lines. A first switching device supplies a voltage from the data line to the liquid crystal cell in response to a voltage at a control terminal. A second switching device applies a gate signal at the ith gate line (wherein i is an integer) to the control terminal in response to a voltage at the (i−1)th gate line, thereby charging said voltage of the control terminal.

7 Claims, 12 Drawing Sheets

LIQUID CRYSTAL DISPLAY DEVICE CAPABLE OF PREVENTING FLICKER AND METHOD FOR DRIVING

This application claims the benefit of Korean Patent Application No. P2003-94972 filed in Korea on Dec. 22, 2003, which is hereby incorporated by reference for all purposes as if fully set forth herein.

BACKGROUND OF THE INVENTION

1. Field of the Invention

This invention relates to a liquid crystal display, and more particularly to a liquid crystal display device and a driving method thereof that are adaptive for improving a picture quality.

2. Description of the Related Art

Generally, a liquid crystal display (LCD) controls the light transmittance of a liquid crystal using an electric field in order to display a picture. To achieve this, the LCD includes a liquid crystal display panel having a pixel matrix and a driving circuit for driving the liquid crystal display panel. The driving circuit drives the pixel matrix such that picture information may be displayed on the display panel.

Referring to FIG. 1, the related art LCD includes a liquid crystal display panel 2, a data driver 4 for driving data lines DL1 to DLm of the liquid crystal display panel 2, and a gate driver 6 for driving gate lines GL1 to GLn of the liquid crystal display panel 2.

The liquid crystal display panel 2 includes of thin film transistors TFT at each crossing of the gate lines GL1 to GLn and the data lines DL1 to DLm and liquid crystal cells connected to the thin film transistors TFT and arranged in a matrix.

The gate driver 6 sequentially applies a gate signal to each gate line GL1 to GLn in response to a control signal from a timing controller (not illustrated). The data driver 4 converts data R, G and B from the timing controller into analog video signals that are applied one horizontal line at a time to the data lines DL1 to DLm every one horizontal period when a gate signal is applied to each gate line GL1 to GLn.

The thin film transistor TFT applies data from the data lines DL1 to DLm to the liquid crystal cell in response to a control signal from the gate lines GL1 to GLn. The liquid crystal cell may be equivalently expressed as a liquid crystal capacitor Clc because it has a common electrode opposed to a pixel electrode connected to the thin film transistor TFT and having a liquid crystal therebetween. Such a liquid crystal cell includes a storage capacitor (not illustrated) connected to a pre-stage gate line in order to keep the data voltage charged in the liquid crystal capacitor Clc until the next data voltage is charged therein.

Such a related art LCD requires operating waveforms as illustrated in FIG. 2 so as to drive the liquid crystal cell.

FIG. 2 is a waveform diagram of a common electrode voltage Vcom, each gate electrode voltage and each data voltage applied to the related art LCD.

Referring to FIG. 2, a common electrode voltage Vcom is applied and a gate signal for driving the thin film transistor TFT is applied. If the thin film transistor TFT is turned on by such a gate signal, then a positive data voltage Vdata(+) is charged into the liquid crystal cell (at a charging area). Thereafter, if the thin film transistor TFT is turned off, then the data voltage Vdata(+) charged by the storage capacitor is maintained (at a maintaining area).

Next, if a gate signal for driving the thin film transistor TFT is re-applied to the gate line at the next frame, then a negative data voltage Vdata(−). Thereafter, if the thin film transistor TFT is turned off, then the data voltage Vdata(−) charged by the storage capacitor is maintained.

When the thin film transistor TFT is turned on to charge a voltage into the liquid crystal cell (at the charging area) and then the thin film transistor TFT is turned off (at the maintaining area). At the thin film transistor TFT, a liquid crystal voltage is varied by ΔVp by a capacitance between a gate electrode G and a source electrode S.

If a sequential gate signal progressing from the upper portion of the liquid crystal display panel 2 toward the lower portion thereof is inputted to the gate line in this manner, then each thin film transistor TFT is simultaneously turned on by an input of the gate signal and a displaying data voltage is inputted from the data line for each pixel. Thus, the data voltage is applied to a pixel electrode, and transmittance of the liquid crystal is changed by a potential difference between the voltage at the pixel electrode and the common electrode voltage.

However, in the thin film transistor TFT of the LCD, roles of a source electrode S and a drain electrode D when the data voltage has a positive(+) polarity are exchanged from roles of the source electrode S and a drain electrode D when the data voltage has a negative(−) polarity. In other words, any one having a lower potential of a data voltage Vdata applied to the data line and a voltage at the liquid crystal capacitor Clc performs a role of the source electrode.

In FIG. 2, the gate signal turning on the thin film transistor TFT is applied as the same gate signal regardless of the polarity of the data voltage Vdata. Thus, a potential difference Vgs1 between said two voltages when a positive data voltage Vdata(+) is applied at the current frame is differentiated from a potential difference Vgs2 between said two voltages when a negative data voltage Vdata(−) is applied at the next frame. Accordingly, the amount of current flowing in the thin film transistor TFT is differentiated causing an imbalance of electric charge in the liquid crystal cell. As a result, a deterioration in picture quality is caused, such as flickering or a residual image, for example.

SUMMARY OF THE INVENTION

Accordingly, it is an advantage of the present invention to provide a liquid crystal display device and a driving method thereof that are adaptive for improving a picture quality.

In order to achieve these and other advantages of the invention, a liquid crystal display device according to one aspect of the present invention includes a plurality of liquid crystal cells provided at crossings of a plurality of data lines and a plurality of gate lines; a first switching device for supplying a voltage from the data line to the liquid crystal cell in response to a voltage at a control terminal; and a second switching device for applying a gate signal at the ith gate line (wherein i is an integer) to the control terminal in response to a voltage at the (i−1)th gate line, thereby charging said voltage of the control terminal.

In the liquid crystal display device, the first switching device has a source terminal connected to the data line and a drain terminal connected to the liquid crystal cell, and the second switching device has a drain terminal connected to a gate terminal of the first switching device, a gate terminal of the second switching device connected to the (i−1)th gate line and a source terminal connected to the ith gate line.

The liquid crystal display device further includes a gate driver for applying a gate signal to the gate lines and for applying an ith gate signal to the ith gate line in such a manner to overlap with an (i−1)th gate signal applied to the (i−1)th gate line during a predetermined time interval after applying said gate signal to the (i−1)th gate line.

In the liquid crystal display device, the first and second switching devices positioned at the ith horizontal line are turned on when said gate signal is applied to the (i−1)th and ith gate lines, and the gate terminal of the first switching device is converted into a floating state when said gate signal applied to the (i−1)th gate line is converted into a low state to thereby keep the first switching device at a turn-on state.

Herein, when the gate terminal of the first switching device is converted into said floating state to keep the first switching device at said turn-on state, a desired video signal is charged into the liquid crystal cell connected to the first switching device.

Herein, said video signal is sequentially inverted to have a positive polarity and a negative polarity.

Herein, said gate signal is bootstrapped in association with said positive and negative video signals sequentially applied to the liquid crystal cell.

Herein, said gate signal is varied such that a potential difference of it from said positive video signal is analogous to a potential difference of it form said negative video signal.

The liquid crystal display device further includes a capacitor connected to a gate terminal of the first switching device such that the first switching device may maintain a turn-on state when the gate terminal of the first switching device is converted into a floating state.

A method of driving a liquid crystal display device, having a liquid crystal cell and first and second switches for driving the liquid crystal cell, according to another aspect of the present invention includes the steps of sequentially applying desired positive and negative video signals to the liquid crystal cell provided at an ith horizontal line when an (i−1)th gate line (wherein i is an integer) is converted into a low state after a gate signal was applied to the (i−1)th and ith gate lines; and bootstrapping said gate signal in association with said positive and negative video signals applied to the liquid crystal cell.

In the method, said step of sequentially applying said desired positive and negative video signals to the liquid crystal cell includes turning on the first switch in response to said gate signal applied to the (i−1)th gate line; turning on the second switch in response to said gate signal applied to the ith gate line when the first switch is turned on; turning off the first switch when said gate signal applied to the (i−1)th gate line is converted into a low state; and floating a gate terminal of the second switch when the first switch is turned off, thereby keeping the second switch at a turn-on state.

In the method, said gate signal is varied such that a potential difference of it from said positive video signal is analogous to a potential difference of it form said negative video signal.

BRIEF DESCRIPTION OF THE DRAWINGS

These and other advantages of the invention will be apparent from the following detailed description of the embodiments of the present invention with reference to the accompanying drawings, in which.

In the drawings.

DETAILED DESCRIPTION OF THE ILLUSTRATED EMBODIMENTS

Reference will now be made in detail to embodiments of the present invention, examples of which are illustrated in the accompanying drawings.

Hereinafter, the embodiments of the present invention will be described in detail with reference to FIGS. 3 to 8.

Figure 1:
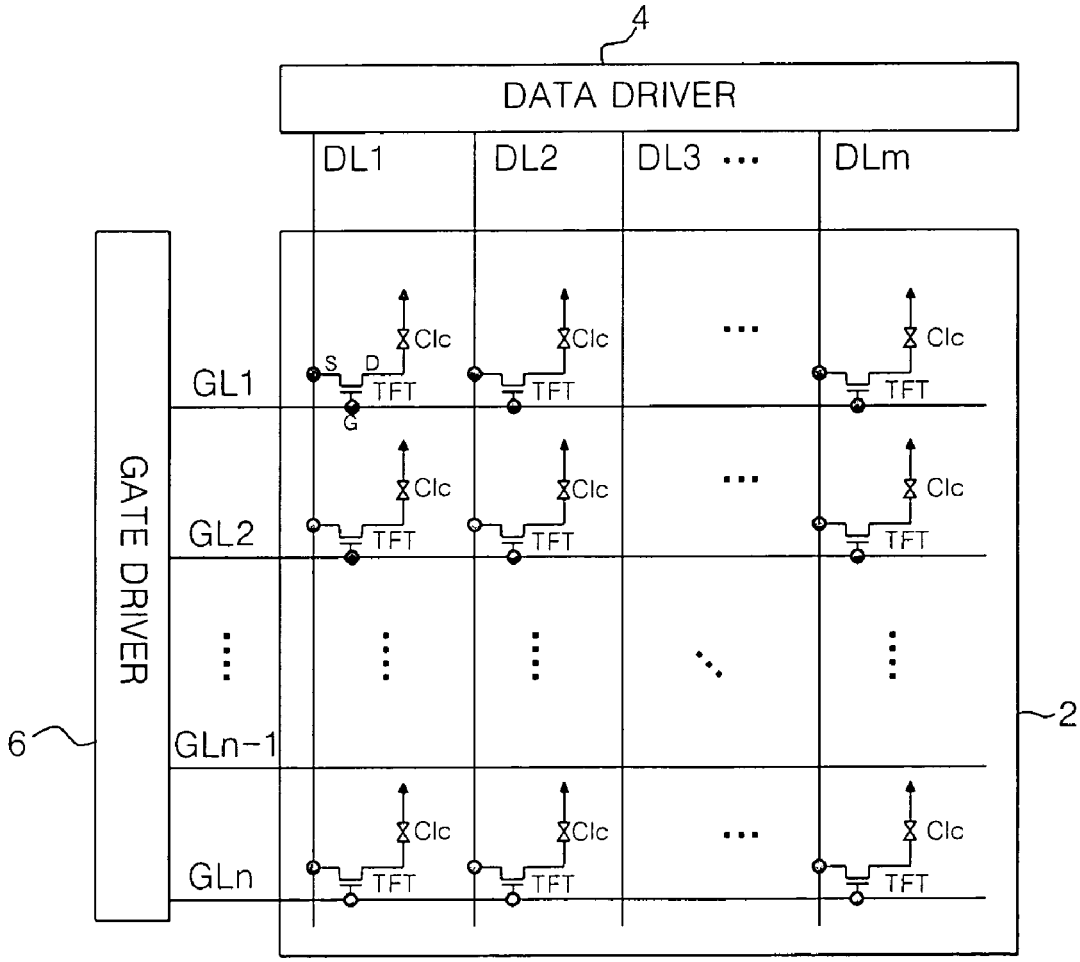
FIG. 1 RELATED ART
FIG. 1 is a block circuit diagram illustrating a configuration of a related art liquid crystal display.
Figure 2:
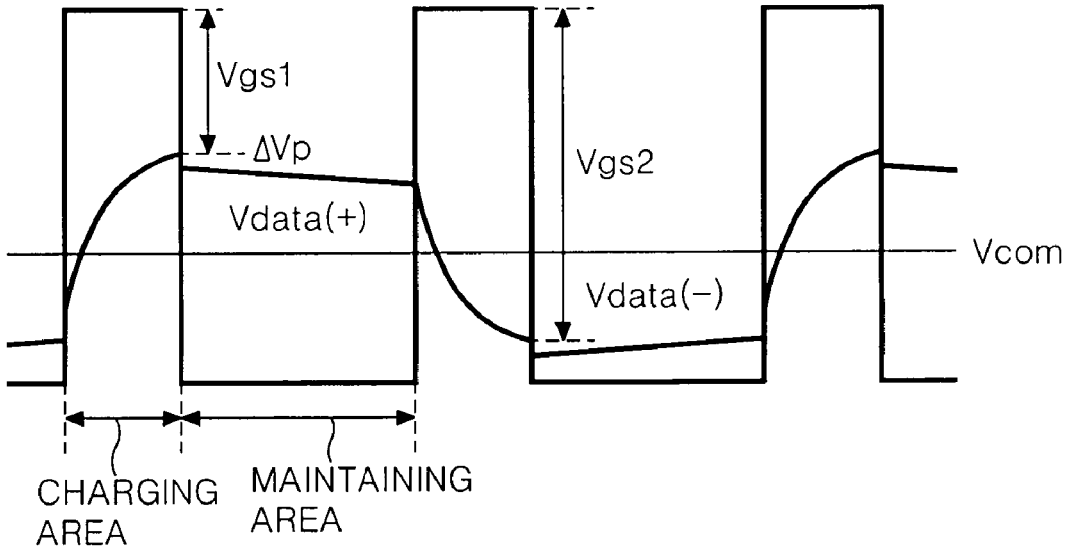
FIG. 2 RELATED ART
FIG. 2 is a waveform diagram of voltages applied to the liquid crystal display illustrated in FIG. 1.
Figure 3:
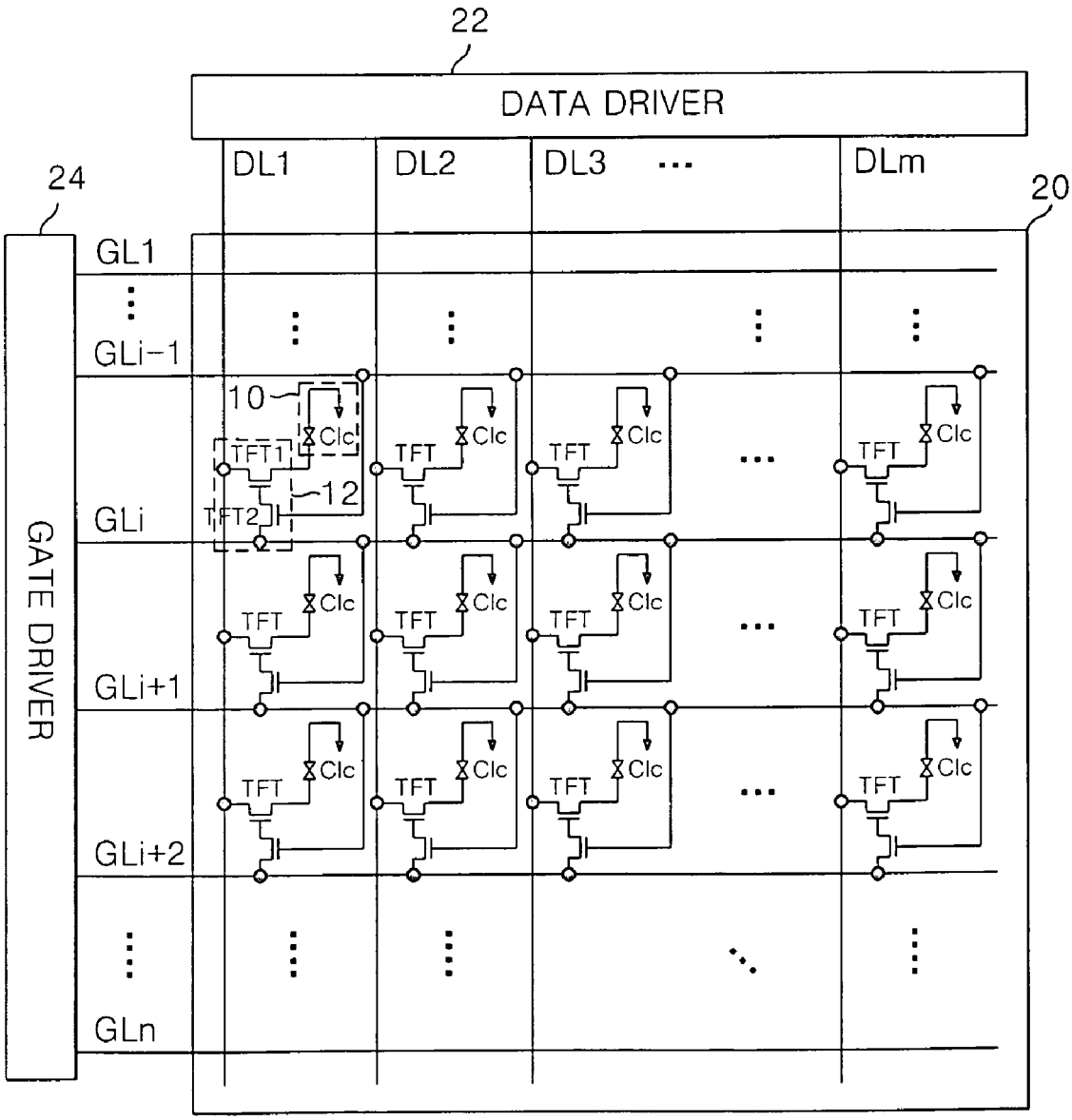
FIG. 3 is a block circuit diagram illustrating a configuration of a liquid crystal display according to an embodiment of the present invention.

FIG. 3 schematically illustrates a liquid crystal display (LCD) according to an embodiment of the present invention.

Referring to FIG. 3, the LCD according to the embodiment of the present invention includes a liquid crystal display panel 20, a data driver 22 for driving data lines DL1 to DLm/2 of the liquid crystal display panel 20, and a gate driver 24 for driving gate lines GL1 to GLn of the liquid crystal display panel 20.

The liquid crystal display panel 20 is comprised of liquid crystal cells 10 provided at crossings of the gate lines GL1 to GLn and the data lines DL1 to DLm/2, and a switching part 12 for driving the liquid crystal cells 10.

The liquid crystal cell 10 may be equivalently expressed as a liquid crystal capacitor Clc because they have a common electrode opposite a pixel electrode connected to each of the switching part 12 and having a liquid crystal therebetween. Herein, each of the liquid crystal cells 10 includes a storage capacitor (not illustrated) connected to a pre-stage gate line (or common electrode) in order to keep a data voltage charged in the liquid crystal capacitor Clc until the next data voltage is charged.

The switching part 12 for driving the liquid crystal cell 10 includes first and second thin film transistors TFT1 and TFT2. A source terminal of the second thin film transistor TFT2 is connected to the ith gate line GLi (wherein i is an integer), and a gate terminal of the second thin film transistor TFT2 is connected to the (i−1)th gate line GLi−1. A gate terminal of the first thin film transistor TFT1 is connected to a drain terminal of the second thin film transistor TFT2, and a source terminal thereof is connected to the adjacent data line DL. Further, a drain terminal of the first thin film transistor TFT1 is connected to the liquid crystal cell 10. The switching part 12 applies a video signal to the liquid crystal cell 10 when the gate terminal of the first thin film transistor TFT1 is kept at a floating state charged with a voltage.

Figure 4:
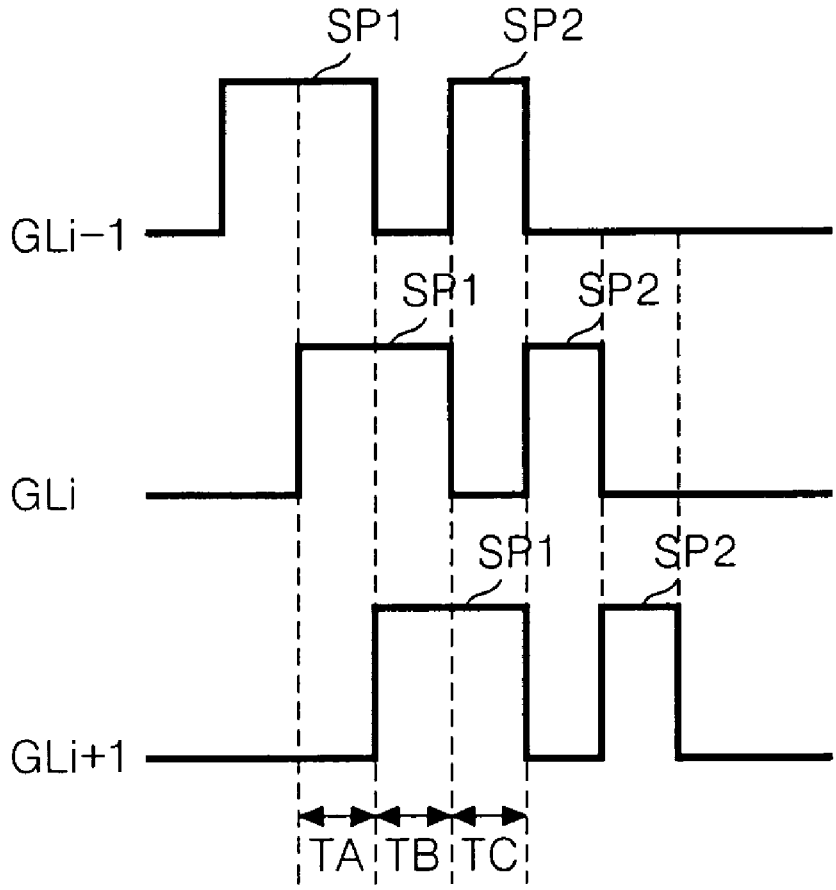
FIG. 4 is a waveform diagram of driving signals for driving the liquid crystal display illustrated in FIG. 3.

The gate driver 24 applies first and second gate signals SP1 and SP2 to each of the gate lines GL1 to GLn as illustrated in FIG. 4 in response to a control signal supplied from a timing controller (not illustrated). The first gate signal SP1 remains at a high state during two horizontal periods 2H while the second gate signal SP2 remains at a high state during one horizontal period 1H. The first gate signal SP1 applied to the (i−1)th gate line GLi−1 overlaps with the first gate signal SP1 applied to the ith gate line GLi during one horizontal period 1H. In other words, the first gate signal SP1 is applied to the (i−1)th gate line GLi−1, and the first gate signal SP1 is applied to the ith gate line GLi in such a manner to rise after one horizontal period 1H.

The data driver 22 converts data R, G and B from the timing controller into analog video signals that are then applied for one horizontal line to the data lines DL1 to DLm every one horizontal period when a gate signal is applied to each gate line GL1 to GLn.

Hereinafter, a procedure of applying a video signal to the liquid crystal cell 10 in the LCD will be described in detail.

Figure 5A:
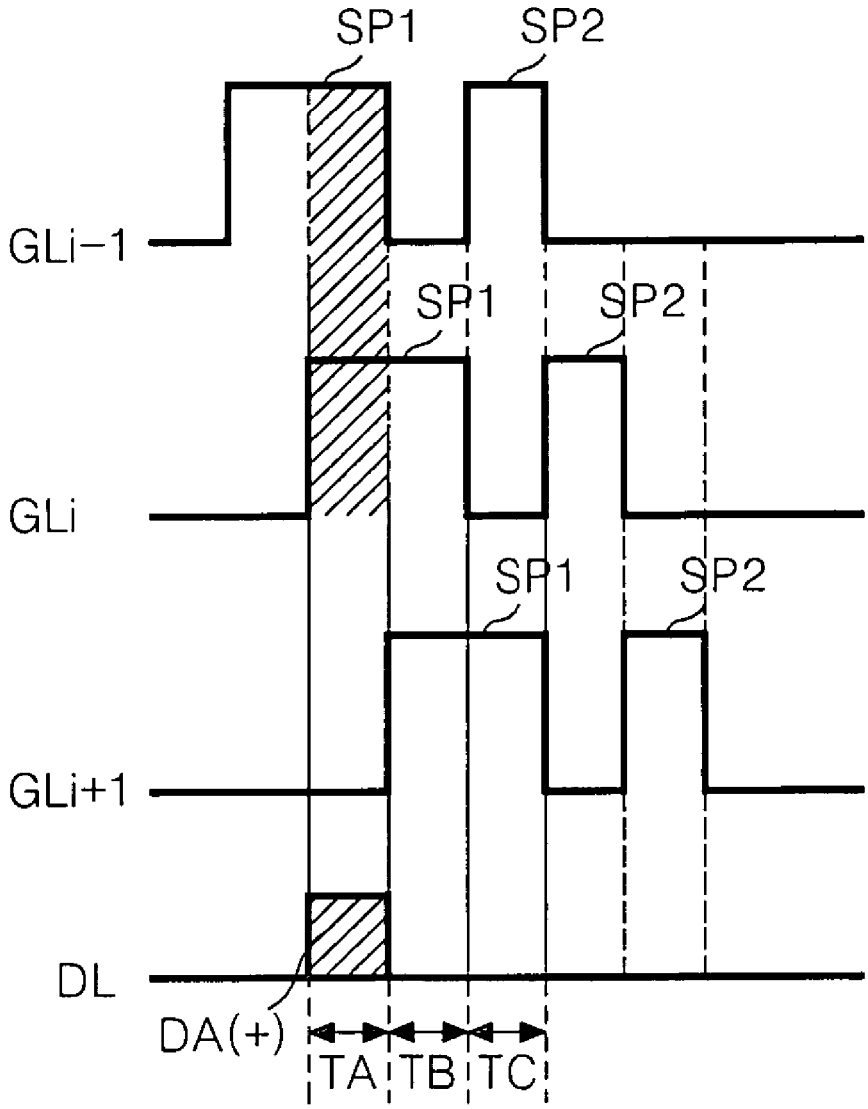
FIG. 5A to FIG. 5C are waveform diagrams of driving signals for driving the liquid crystal display illustrated in FIG. 3 when a data having a positive polarity is supplied.

In a first time interval TA, as seen from an oblique-lined portion in FIG. 5A, the first gate signal SP1 is applied to the (i−1)th gate line GLi−1 and, at the same time, the first gate signal SP1 is applied to the ith gate line GLi.

The first gate signal SP1 applied to the (i−1)th gate line GLi−1 turns on the second thin film transistor TFT2 provided at the ith horizontal line. Further, the first gate signal SP1 applied to the ith gate line GL1 turns on the first thin film transistor TFT1 by way of the second thin film transistor TFT2 provided at the ith horizontal line.

In other words, if the first gate signal SP1 is applied to the (i−1)th gate line GLi−1 and, at the same time, is applied to the ith gate line GLi, then the liquid crystal cell 10 provided at the ith horizontal line is connected to the data line DL. At this time, a positive first video signal DA(+) to be applied to the liquid crystal cell 10 provided at the (i−1)th horizontal line is sent to the data line DL. Thus, the positive first video signal DA(+) is charged in the liquid crystal cell 10 provided at the ith horizontal line.

Figure 5B:
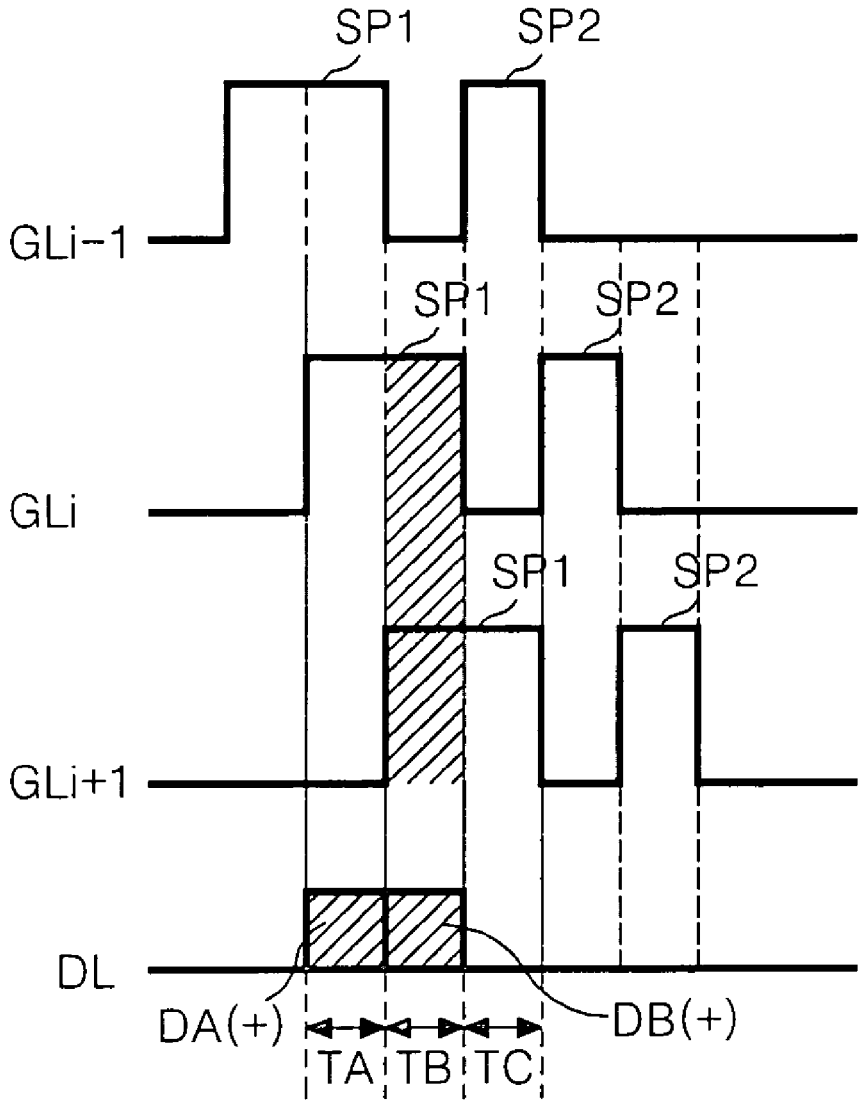

In a second time interval TB following the first time interval TA, as seen from an oblique-lined portion in FIG. 5B, a gate signal is not applied to the (i−1)th gate line GLi−1 while the first gate signal SP1 is applied to the ith gate line GLi and the (i+1)th gate line GLi+1. If a gate signal is not applied to the (i−1)th gate line GLi−1, then the second thin film transistor TFT2 provided at the ith horizontal line is turned off. The first thin film transistor TFT1 remains in an ON state by the first gate signal SP1 applied in the previous time interval (i.e., the first time interval TA).

Figure 7:
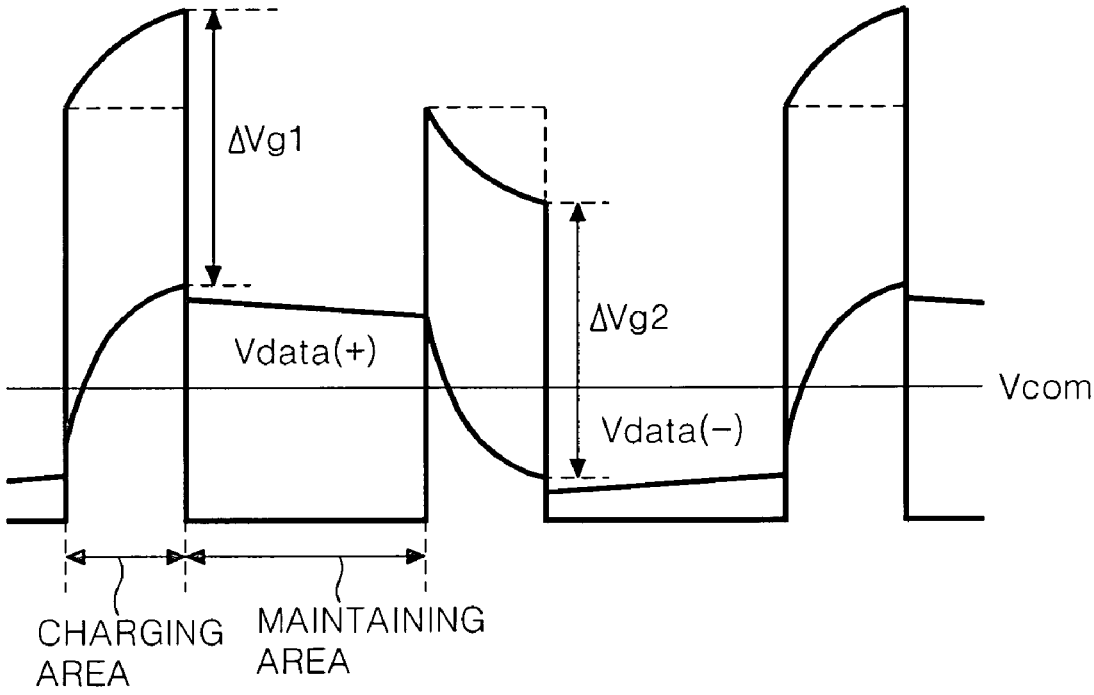
FIG. 7 is a waveform diagram of voltages applied to the liquid crystal display illustrated in FIG. 3.

In other words, because the gate terminal of the first thin film transistor TFT1 is converted from one state to a floating state having received the first gate signal SP1. Because the second thin film transistor TFT2 is turned off prior to the first thin film transistor TFT1, the first thin film transistor TFT1 remains at a turn-on state during the second time interval TB. Because the first gate signal SP1 applied to the (i−1)th gate line GLi−1 is converted into a low state prior to the first gate signal SP1 being applied to the ith gate line GLi, the gate terminal of the first thin film transistor TFT1 is floated into a state having been charged with the first gate signal SP1. During the second time interval TB, a positive second video signal DB(+) to be supplied to the liquid crystal cell provided at the ith horizontal line is sent to the data line DL. Thus, the positive second video signal DB(+) to be supplied to the data line DL is applied, via the first thin film transistor TFT1 provided at the ith horizontal line, to the liquid crystal cell 10, so that a desired positive second video signal DB(+) is charged into the liquid crystal cell 10 provided at the ith horizontal line (at the charging area). Because the gate terminal of the first thin film transistor TFT1 has been floated into a state charged with the first gate signal SP1, the first gate signal SP1 rises by the positive second video signal DB(+) as illustrated in FIG. 7 by a bootstrap when the positive second video signal DB(+) is applied to the liquid crystal cell 10 provided at the ith horizontal line.

If the first gate signal SP1 is applied to the ith gate line GLi and at the same time is applied to the (i+1)th gate line GLi+1, then the liquid crystal cell 10 provided at the (i+1)th horizontal line is connected to the data line DL. The positive second video signal DB(+) to be supplied to the liquid crystal cell 10 provided at the ith horizontal line is sent to the data line DL. Thus, the positive second video signal DB(+) is charged into the liquid crystal cell 10 provided at the (i+1)th horizontal line.

Figure 5C:
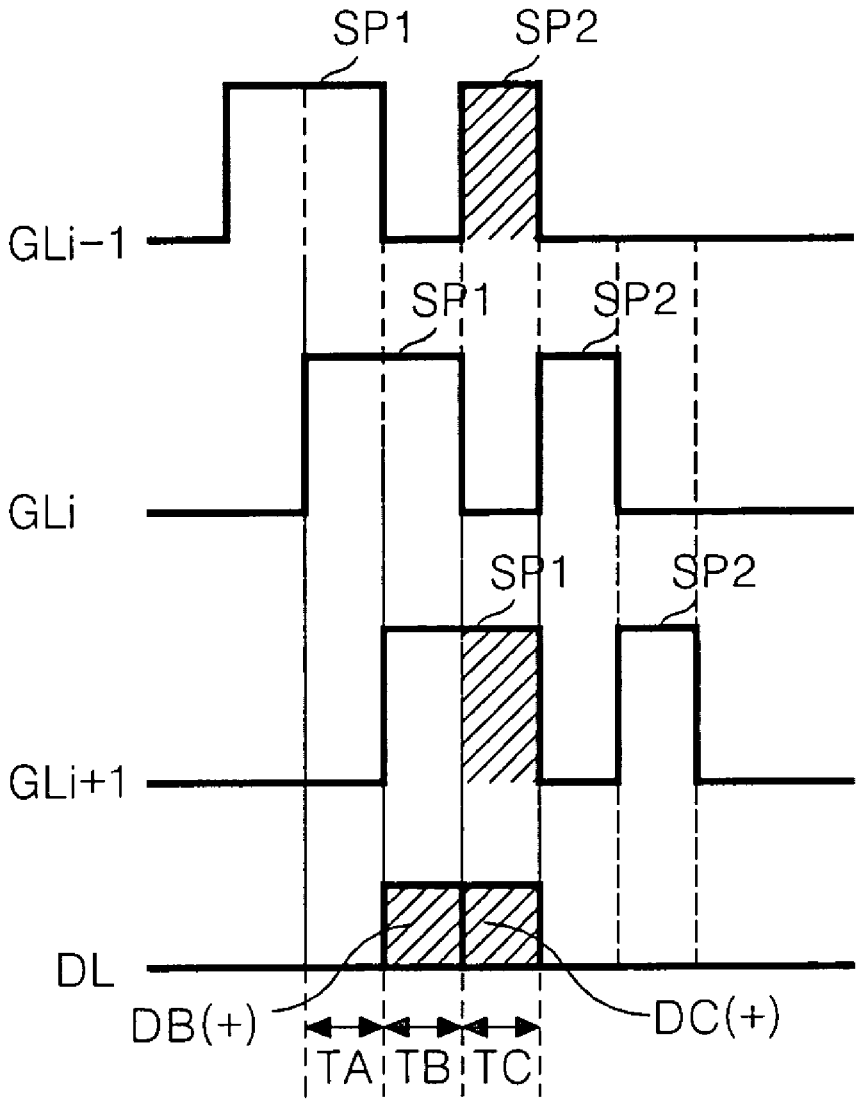

In a third time interval TC following the second time interval TB, as seen from an oblique-lined portion in FIG. 5C, a gate signal is not applied to the ith gate line GLi; the second gate signal SP2 is applied to the (i−1)th gate line GLi−1; and the first gate signal SP1 is applied to the (i+1)th gate line GLi+1. If a gate signal is not applied to the ith gate line GLi, then the second thin film transistor TFT2 provided at the (i+1)th horizontal line is turned off. The first thin film transistor TFT1 remains at an ON state by the first gate signal SP1 applied in the previous time interval (i.e., the second time interval TB). In other words, because the gate terminal of the first thin film transistor TFT1 is converted from a state having received the first gate signal SP1 into a floating state (because the second thin film transistor TFT2 is turned off prior to the first thin film transistor TFT1), the first thin film transistor TFT1 remains at a turn-on state during the third time interval TC. Because the first gate signal SP1 applied to the ith gate line GLi is converted into a low state prior to the first gate signal SP1 applied to the (i+1)th gate line GLi+1, the gate terminal of the first thin film transistor TFT1 is floated into a state having been charged with the first gate signal SP1.

During the third time interval TC, a positive third video signal DC(+) to be supplied to the liquid crystal cell provided at the (i+1)th horizontal line is sent to the data line DL. Thus, the positive third video signal DC(+) to be supplied to the data line DL is applied, via the first thin film transistor TFT1 provided at the (i+1)th horizontal line, to the liquid crystal cell 10, so that a desired positive third video signal DC(+) is charged into the liquid crystal cell 10 provided at the (i+1)th horizontal line. At this time, since the gate terminal of the first thin film transistor TFT1 has been floated into a state charged with the first gate signal SP1, the first gate signal SP1 rises by the positive third video signal DC(+) by a bootstrap when the positive third video signal DC(+) is applied to the liquid crystal cell 10 provided at the (i+1)th horizontal line.

Further, the second gate signal SP2 is applied to the (i−1)th gate line GLi−1 to thereby turn on the second thin film transistor TFT2 provided at the ith horizontal line. Thus, the gate terminal of the first thin film transistor TFT1 goes beyond a floating state and is not supplied with a gate signal to turn off the first thin film transistor TFT1, so that it maintains the positive second video signal DB(+) charged by the storage capacitor (at the maintaining area). Accordingly, as illustrated in FIG. 7, a potential difference between a voltage of the gate signal applied to the ith gate line GLi and a voltage of the positive second video signal DB(+) becomes ΔVg1.

Figure 6A:
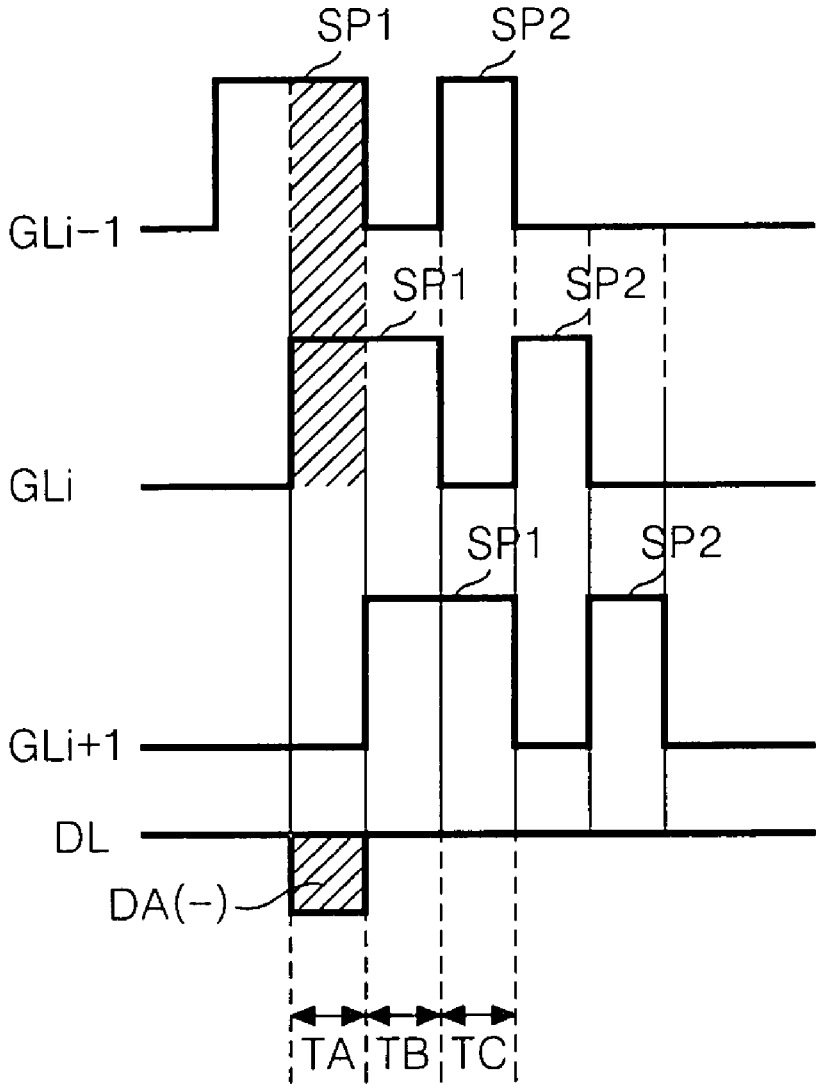
FIG. 6A to FIG. 6C are waveform diagrams of driving signals for driving the liquid crystal display illustrated in FIG. 3 when a data having a negative polarity is supplied.

Subsequently, in the first time interval TA of the next frame, the first gate signal SP1 is applied to the (i−1)th gate line GLi−1 and, at the same time, is applied to the ith gate line GLi, as seen from an oblique-lined portion in FIG. 6A, The first gate signal SP1 applied to the (i−1)th gate line GLi−1 turns on the second thin film transistor TFT2 provided at the ith horizontal line. Further, the first gate signal SP1 applied to the ith gate line GL1 turns on the first thin film transistor TFT1 by way of the second thin film transistor TFT2 provided at the ith horizontal line.

In other words, if the first gate signal SP1 is applied to the (i−1)th gate line GLi−1 and, at the same time, is applied to the ith gate line GLi, then the liquid crystal cell 10 provided at the ith horizontal line is connected to the data line DL. A negative first video signal DA(−) to be applied to the liquid crystal cell 10 provided at the (i−1)th horizontal line is sent to the data line DL. Thus, the negative first video signal DA(−) is charged in the liquid crystal cell 10 provided at the ith horizontal line.

Figure 6B:
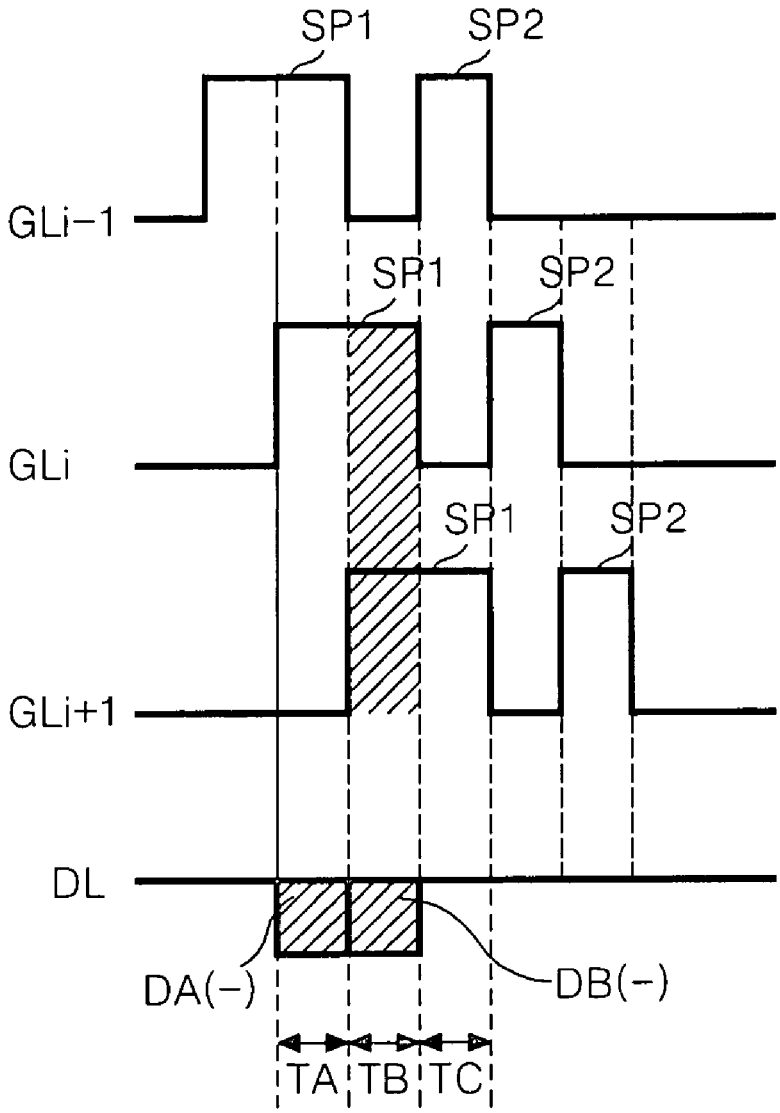

In a second time interval TB following the first time interval TA, as illustrated in the oblique-lined portion in FIG. 6B, a gate signal is not applied to the (i−1)th gate line GLi−1 while the first gate signal SP1 is applied to the ith gate line GLi and the (i+1)th gate line GLi+1. If a gate signal is not applied to the (i−1)th gate line GLi−1, then the second thin film transistor TFT2 provided at the ith horizontal line is turned off. The first thin film transistor TFT1 remains at an ON state by the first gate signal SP1 applied in the previous time interval (i.e., the first time interval TA). In other words, since the gate terminal of the first thin film transistor TFT1 is converted from a state having received the first gate signal SP1 into a floating state, that is, since the second thin film transistor TFT2 is turned off prior to the first thin film transistor TFT1, the first thin film transistor TFT1 remains at a turn-on state during the second time interval TB. That is, because the first gate signal SP1 applied to the (i−1)th gate line GLi−1 is converted into a low state prior to the first gate signal SP1 applied to the ith gate line GLi, the gate terminal of the first thin film transistor TFT1 is floated into a state having been charged with the first gate signal SP1.

During the second time interval TB, a negative second video signal DB(−) to be supplied to the liquid crystal cell 10 provided at the ith horizontal line is sent to the data line DL. Thus, the negative second video signal DB(−) to be supplied to the data line DL is applied, via the first thin film transistor TFT1 provided at the ith horizontal line, to the liquid crystal cell 10, so that a desired negative second video signal DB(−) is charged into the liquid crystal cell 10 provided at the ith horizontal line (at the charging area). Because the gate terminal of the first thin film transistor TFT1 has been floated into a state charged with the first gate signal SP1, the first gate signal SP1 rises by the negative second video signal DB(−) as illustrated in FIG. 7 by a bootstrap when the negative second video signal DB(−) is applied to the liquid crystal cell 10 provided at the ith horizontal line.

On the other hand, if the first gate signal SP1 is applied to the ith gate line GLi and, at the same time, is applied to the (i+1)th gate line GLi+1, then the liquid crystal cell 10 provided at the (i+1)th horizontal line is connected to the data line DL. The negative second video signal DB(−) to be supplied to the liquid crystal cell 10 provided at the ith horizontal line is sent to the data line DL. Thus, the negative second video signal DB(−) is charged into the liquid crystal cell 10 provided at the (i+1)th horizontal line.

Figure 6C:
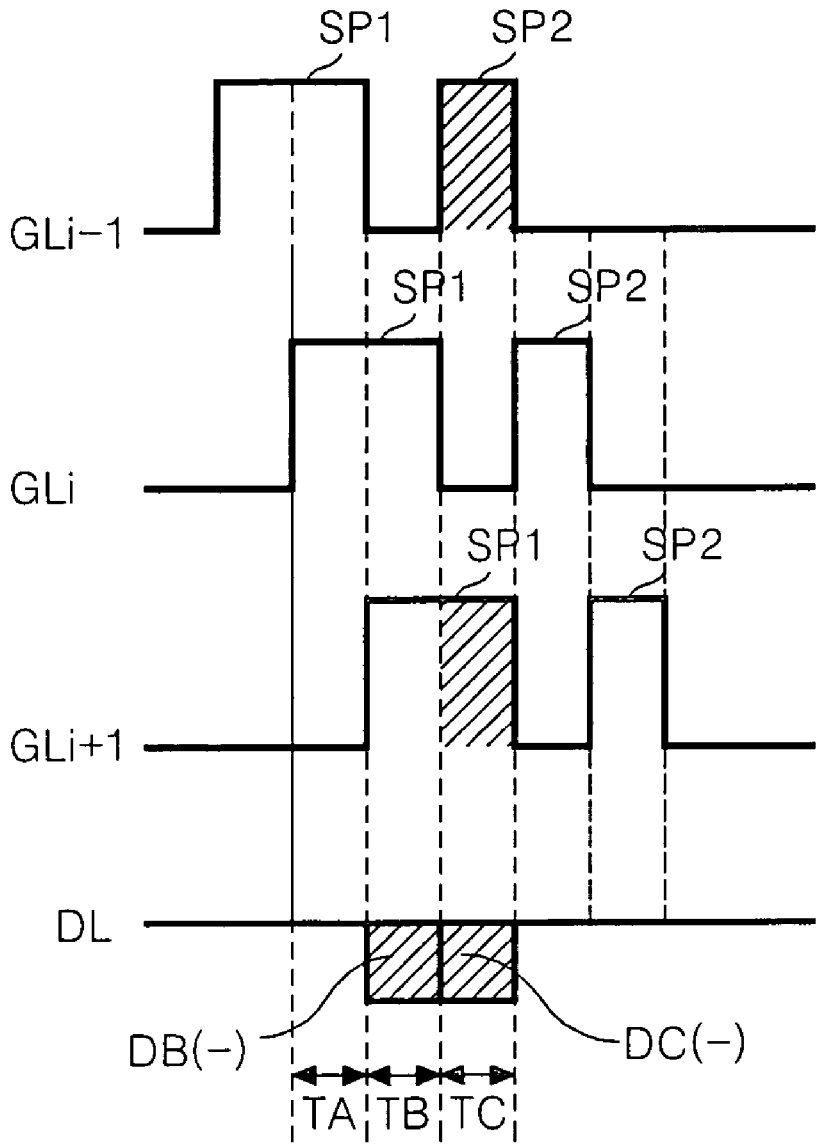

In a third time interval TC following the second time interval TB, as illustrated in the oblique-lined portion in FIG. 6C, a gate signal is not applied to the ith gate line GL1; the second gate signal SP2 is applied to the (i−1)th gate line GLi−1; and the first gate signal SP1 is applied to the (i+1)th gate line GLi+1. If a gate signal is not applied to the ith gate line GLi, then the second thin film transistor TFT2 provided at the (i+1)th horizontal line is turned off. The first thin film transistor TFT1 remains at an ON state by the first gate signal SP1 applied in the previous time interval (i.e., the second time interval TB). In other words, since the gate terminal of the first thin film transistor TFT1 is converted from a state having received the first gate signal SP1 into a floating state, that is, since the second thin film transistor TFT2 is turned off prior to the first thin film transistor TFT1, the first thin film transistor TFT1 remains at a turn-on state during the third time interval TC. That is, because the first gate signal SP1 applied to the ith gate line GLi is converted into a low state prior to the first gate signal SP1 applied to the (i+1)th gate line GLi+1, the gate terminal of the first thin film transistor TFT1 is floated into a state having been charged with the first gate signal SP1.

During the third time interval TC, a negative third video signal DC (−) to be supplied to the liquid crystal cell provided at the (i+1)th horizontal line is sent to the data line DL. Thus, the negative third video signal DC (−) to be supplied to the data line DL is applied, via the first thin film transistor TFT1 provided at the (i+1)th horizontal line, to the liquid crystal cell 10, so that a desired negative third video signal DC (−) is charged into the liquid crystal cell 10 provided at the (i+1)th horizontal line. At this time, since the gate terminal of the first thin film transistor TFT1 has been floated into a state charged with the first gate signal SP1, the first gate signal SP1 rises by the negative third video signal DC(−) by a bootstrap when the negative third video signal DC(−) is applied to the liquid crystal cell 10 provided at the (i+1)th horizontal line.

Further, the second gate signal SP2 is applied to the (i−1)th gate line GLi−1 to thereby turn on the second thin film transistor TFT2 provided at the ith horizontal line. Thus, the gate terminal of the first thin film transistor TFT1 goes beyond a floating state and is not supplied with a gate signal to turn off the first thin film transistor TFT1, so that it maintains the negative second video signal DB(−) charged by the storage capacitor (at the maintaining area). Accordingly, as illustrated in FIG. 7, a potential difference between a voltage of the gate signal applied to the ith gate line GLi and a voltage of the negative second video signal DB(−) becomes ΔVg2 almost similar to ΔVg1.

In the LCD according to the embodiment of the present invention, a gate signal rises by the bootstrap in association with a positive polarity of data when the positive polarity of data is supplied at the current frame, and a gate signal falls by the bootstrap in association with a negative polarity of data when the negative polarity of data is supplied at the next frame. Thus, a potential difference ΔVg1 between said two voltages when the positive data voltage is supplied at the current frame becomes almost similar to a potential difference ΔVg2 when the negative data voltage is supplied at the next frame. Accordingly, current amounts flowing in the thin film transistors TFT's are equal to each other, so that uniform electric charges are charged into the liquid crystal cells. As a result, it becomes possible to eliminate a flicker such a tinkling of the screen and a residual image, thereby improving a picture quality.

Figure 8:
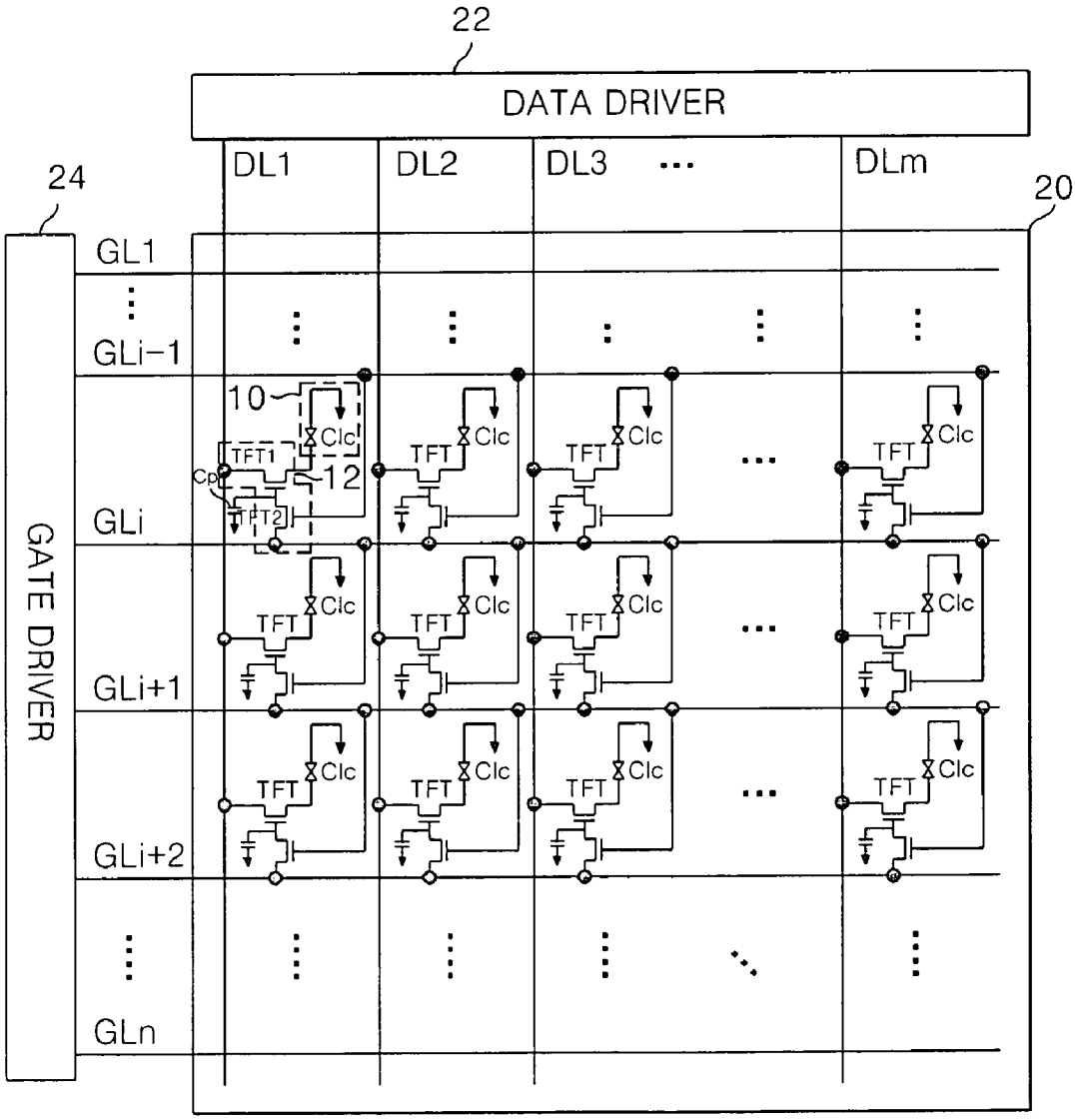
FIG. 8 is a block circuit diagram illustrating a configuration of a liquid crystal display according to another embodiment of the present invention.

Alternatively, in the present invention, a capacitor Cp connected to the gate terminal of the first thin film transistor TFT1 as illustrated in FIG. 8 may be further provided. This capacitor Cp charges the first gate signal SP1 applied to the previous gate line during the first time interval TA and applies the first gate signal SP1 charged therein to the gate terminal of the first thin film transistor TFT1 during the second time interval TB, thereby allowing the first thin film transistor TFT1 to stably maintain a turn-on state during the second time interval TB. In this case, a capacitance value of the capacitor is set to approximately 1 pF to 500 pF. Since the other operation procedure is identical to the operation procedure in the embodiment of the present invention illustrated in FIG. 3, a detailed explanation as to this is omitted.

As described above, according to the present invention, a gate signal rises by the bootstrap in association with a positive polarity of data when the positive polarity of data is supplied at the current frame, and a gate signal falls by the bootstrap in association with a negative polarity of data when the negative polarity of data is supplied at the next frame. Thus, a potential difference between said two voltages when the positive data voltage is supplied at the current frame becomes almost similar to a potential difference when the negative data voltage is supplied at the next frame. Accordingly, current amounts flowing in the thin film transistors TFT's are equal to each other, so that uniform electric charges are charged into the liquid crystal cells. As a result, it becomes possible to eliminate a flicker such a tinkling of the screen and a residual image, thereby improving a picture quality.

Although the present invention has been explained by the embodiments illustrated in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display device capable of preventing flicker, comprising:

a plurality of liquid crystal cells provided at crossings of a plurality of data lines and a plurality of gate lines;

a first switching device for supplying a video signal, wherein said video signal is sequentially inverted to have a positive video signal and a negative video signal from the data line to the liquid crystal cell in response to a voltage at a control terminal;

a second switching device for applying a gate signal at the ith gate line to the control terminal in response to a voltage at the i−1 th gate line, thereby charging said voltage of the control terminal, wherein i is an integer; and a capacitor connected to a gate terminal of the first switching device such that the first switching device maintains a turn-on state when the gate terminal of the first switching device is converted into a floating state;

wherein the gate signal includes first and second gate signals;

wherein the first gate signal and second gate signal are one horizontal period apart;

wherein the first gate signal remains at a high state during two horizontal periods while the second gate signal remains at a high state during one horizontal period, and the first gate signal applied to the i−1 th gate line overlaps with the first gate signal applied to the ith gate line during one horizontal period;

wherein the first gate signal is applied to the i−1 th gate line, and the first gate signal is applied to the ith gate line in such a manner to rise after one horizontal period;

wherein the first gate signal applied to the floated gate terminal of the first switching device rises by the positive video signal by a bootstrap when the positive video signal is applied to the liquid crystal cell provided at the ith horizontal line;

wherein the first gate signal applied to the floated gate terminal of the first switching device falls by the negative video signal by a bootstrap when the negative video signal is applied to the liquid crystal cell provided at the ith horizontal line.

2. The liquid crystal display device according to claim 1, wherein the first switching device has a source terminal connected to the data line and a drain terminal connected to the liquid crystal cell, and the second switching device has a drain terminal connected to a gate terminal of the first switching device, a gate terminal of the second switching device, connected to the i−1 th gate line, and a source terminal connected to the ith gate line.

3. The liquid crystal display device according to claim 2, wherein the first and second switching devices positioned at the ith horizontal line are turned on when said first gate signal is applied to the i−1 th and ith gate lines, and the gate terminal of the first switching device is converted into a floating state when said first gate signal applied to the i−1 th gate line is converted into a low state to thereby keep the first switching device at a turn-on state.

4. The liquid crystal display device according to claim 3, wherein, when the gate terminal of the first switching device is converted into said floating state to keep the first switching device at said turn-on state, a desired video signal is charged into the liquid crystal cell connected to the first switching device.

5. The liquid crystal display device according to claim 4, wherein said first gate signal is varied such that a potential difference between the gate signal and said positive video signal is analogous to a potential difference between the gate signal and said negative video signal.

6. A method of driving a liquid crystal display device capable of preventing flicker, having a liquid crystal cell and first and second switches for driving the liquid crystal cell, said method comprising:

sequentially applying desired positive and negative video signals to the liquid crystal cell provided at an ith horizontal line when an i−1 th gate line is converted into a low state after a gate signal was applied to the i−1 th and ith gate lines, wherein i is an integer; and bootstrapping said gate signal in association with said positive and negative video signals applied to the liquid crystal cell; and wherein a capacitor is connected to a gate terminal of the first switching device such that the first switching device maintains a turn-on state when the gate terminal of the first switching device is converted into a floating state;

wherein said sequentially applying said desired positive and negative video signals to the liquid crystal cell includes: turning on the first switch in response to said gate signal applied to the i−1 th gate line; turning on the second switch in response to said gate signal applied to the ith gate line when the first switch is turned on; turning off the first switch when said gate signal applied to the i−1 th gate line is converted into a low state; and floating a gate terminal of the second switch when the first switch is turned off, thereby keeping the second switch at a turn-on state;

wherein the gate signal includes first and second gate signals;

wherein the first gate signal and second gate signal are one horizontal period apart;

wherein the first gate signal remains at a high state during two horizontal periods while the second gate signal remains at a high state during one horizontal period, and the first gate signal applied to the i−1 th gate line overlaps with the first gate signal applied to the ith gate line during one horizontal period;

wherein the first gate signal is applied to the i−1 th gate line, and the first gate signal is applied to the ith gate line in such a manner to rise after one horizontal period;

wherein the first gate signal applied to the floated gate terminal of the second switching device rises by the positive video signal by a bootstrap when the positive video signal is applied to the liquid crystal cell provided at the ith horizontal line;

wherein the first gate signal applied to the floated gate terminal of the second switching device falls by the negative video signal by a bootstrap when the negative video signal is applied to the liquid crystal cell provided at the ith horizontal line.

7. The method according to claim 6, wherein said first gate signal applied to the floated gate terminal of the second switching device is varied such that a potential difference of it from said positive video signal is analogous to a potential difference of it form said negative video signal.

* * * * *